US005119707A

United States Patent [19]

Fischer

[11] Patent Number: 5,119,707

[45] Date of Patent: Jun. 9, 1992

[54] CLAMP BAR FOR MACHINE ROLL

[75] Inventor: David L. Fischer, De Pere, Wis.

[73] Assignee: Green Bay Engineering and Technical Service, Ltd., Green Bay, Wis.

[21] Appl. No.: 672,732

[22] Filed: Mar. 21, 1991

Related U.S. Application Data

[63] Continuation of Ser. No. 279,756, Dec. 5, 1988, abandoned.

[51] Int. Cl.[5] ..... B26D 1/62

[52] U.S. Cl. ..... 83/698; 83/346; 83/674

[58] Field of Search ..... 83/663, 674, 698, 699, 83/700, 346, 348, 343, 345; 144/230, 172, 174

[56] References Cited

U.S. PATENT DOCUMENTS

| | | | |
|---|---|---|---|
| 1,818,042 | 8/1931 | Christman . | |
| 2,318,838 | 5/1943 | Conradson . | |
| 2,630,039 | 3/1953 | Klemm . | |
| 2,797,602 | 7/1957 | Atherholt, Sr. et al. . | |
| 2,797,603 | 7/1957 | Atherholt et al. . | |
| 2,797,604 | 7/1957 | Atherholt et al. . | |
| 2,801,694 | 8/1957 | Schneider et al. | 83/698 X |
| 3,008,366 | 11/1961 | Taylor, Jr. | 83/346 |
| 3,251,256 | 5/1966 | McGrath | 83/674 |
| 3,516,681 | 6/1970 | Cox et al. . | |
| 3,769,868 | 11/1973 | Hornung | 83/348 |
| 3,951,024 | 4/1976 | Weiskopf | 83/498 |
| 4,131,047 | 12/1978 | Schriber et al. | 83/698 |
| 4,455,903 | 6/1984 | Kesten | 83/346 |
| 4,572,526 | 2/1986 | Jonsson | 279/4 |
| 4,594,928 | 6/1986 | Thomas et al. | 83/698 |
| 4,658,875 | 4/1987 | Grabovac | 144/230 |
| 4,671,154 | 6/1987 | Thomas et al. | 83/698 |
| 4,715,250 | 12/1987 | Rosemann | 83/698 X |

FOREIGN PATENT DOCUMENTS 3046094 6/1982 Fed. Rep. of Germany .

*Primary Examiner*—Douglas D. Watts
*Assistant Examiner*—Eugenia A. Jones
*Attorney, Agent, or Firm*—Andrus, Sceales, Starke & Sawall

[57] ABSTRACT

A fabricated clamp bar that goes into a channel in a machine roll to hold a knife, anvil, or other tool in the channel. The bar has an internal cavity or chamber in one side of the bar. The chamber has an exposed movable outer side wall placed at the side of the machine roll channel. When the internal cavity or chamber is pressurized with a non-compressible fluid such as grease, the movable side of the chamber is forced outward causing the bar to expand in width, causing the clamping side of the bar to trap the tool to be held in the roll against the side of the channel in the roll of the machine. Also disclosed is the use of an intermediate buffer block between the clamp bar and tool to be held in the roll. Spring loaded members may lightly clamp and pre-position the tool via strategically located holes at each end of the tool until pressure is applied to the fluid.

9 Claims, 5 Drawing Sheets

CLAMP BAR FOR MACHINE ROLL

This is a continuation of application Ser. No. 07/279,756, filed Dec. 5, 1988, now abandoned.

The following invention relates to the subject of the Disclosure Document for a Fabricated Clamp Bar for Paper Cutting Rolls, Ser. No. 148,784 filed at the U.S. Patent and Trademark Office on Apr. 16, 1986.

BACKGROUND OF THE INVENTION

The present invention relates to improvements in means for clamping a knife or anvil to a machine roll. In the past, various means have been used to clamp knives or other tools to machine rolls. U.S. Pat. No. 3,008,366 (Taylor) discloses a mechanism in which a flexible air tube exerts controllable pressure radially outwardly against the cutting knife. Unlike the present invention, the object in Taylor is not to hold the cutting knife in a single position, but to hold it resiliently against radial movement under controllable pressure. The object in the present invention is to fix the blade in a channel. Also, pressure is exerted in a different direction and from a different type of chamber in the present invention than in Taylor. U.S. Pat. No. 3,951,024 (Weiskopf) shows a device similar to that in Taylor in which an inflatable hose drives a bar outwardly in its slot to lock a key in a key way to prevent a slitter from moving axially. U.S. Pat. No. 4,455,903 (Kesten) shows a structure in which the entire circumference of a roller can be expanded slightly by pumping hydraulic fluid under the surface of the roller. A piston controls the system. U.S. Pat. No. 1,818,042 (Christman) likewise has a chamber extending completely around the inside of cylindrical arbor so that the arbor may be expanded radially to hold the work piece. U.S. Pat. No. 2,318,838 (Conradson) is similar, but unlike previously mentioned patents, it does not use very high pressures. U.S. Pat. No. 2,630,039 (Klemm) likewise has an expansion arbor but the surface is fluted rather than cylindrical. Nevertheless, the object in Klemm is to expand the entire outer surface. U.S. Pat. Nos. 2,797,602; 2,797,603; and 2,797,604 (Atherholdt) also have expansible cylindrical outer surfaces. U.S. Pat. No. 3,516,681 applies to the principal to an internal cylindrical surface. U.S. Pat. No. 4,572,526 (Jonsson) shows a tool clamping structure. The patent relates primarily to the structure for producing the clamping pressure which is a nut riding on ball bearings to exert pressure against the piston. German Pat. No. 3,046,094 is similar to several of the patents previously discussed in which an expansible cylinder is expanded by hydraulic pressure.

The conventional way of holding cutting blades in cylinders is a bar containing a series of tapped holes (usually ⅜-24 NF) on 1¼ inch (approximately) centers. (See FIG. 11) With each hole containing a hex head bolt, the bolts are "backed-out" forcing the bar against the blade to lock it in position. The present invention greatly reduces the clamping time. Instead of having to turn every one of many bolts to clamp the bar against the roll, all that one needs to do with the present invention is fill the bar with a grease gun or other source of fluid under pressure. This invention also clamps more evenly, without elaborate procedures that are needed to apply the same torque at each prior art bolt.

SUMMARY OF THE INVENTION

The invention comprises a fabricated clamp bar for use in a roll of a machine which holds a knife or anvil. The primary use of this structure is in paper cutting rolls in which a knife blade held in the roller comes around as the roller turns and approaches an anvil to cut off or perforate one or more sheets of paper running between the rollers. The wedging action requires great clamping force. The action is at very high speeds. The present invention is designed to be inserted in a tool channel in a machine roll. When a knife or anvil has been placed flat against one of the sides of the channel, the bar will fit into the space left over in the channel in the machine roll with only a few thousandths of an inch separating the bar, the knife or anvil, and the channel sides. The bar has an internal cavity or chamber on one side which is filled with a non-compressible fluid, preferably grease. When pressure is applied by known means to the internal chamber, the chamber wall on the side of the bar adjacent to the tool to be clamped, acts like a diaphragm and moves outwardly, trapping the tool against the wall of the channel. When pressure is reduced by known means, the wall of the internal cavity returns to its original shape, allowing the bar/knife or bar/anvil combination to be disassembled. Preferably, the internal chamber is rectangular to move the side evenly against the tool. In the preferred embodiment the bar is an aluminum extrusion so that the internal chamber is an integral part of the bar. However, the internal chamber can be created by machining a cavity in one side of a solid bar and then welding a thin metal plate over the machined cavity. Spring loaded balls may be provided to lightly hold the tool until it is clamped. Another feature of the invention is that because it uses a non-compressible fluid and utilizes the principals of hydraulics, it can be made to virtually any length. Also, a buffer may be inserted between the clamp bar and blade to; 1) reduce wear on the bar, 2) compensate for different blade thicknesses, 3) present a different coefficient of friction to the blade.

The blade is set by inserting it so that it projects approximately 0.030 inches to 0.060 inches farther out of the roll than when it is set. The blade is lightly clamped and the roll rotated into its mating position with the rotating anvil roll. As the blade and anvil contact at their nip, the blade is forced back into its machine channel to the exact profile of the anvil thereby allowing a line contact. Once set, the blade is firmly grasped by increasing the pressure of the fluid in the clamp bar and is ready to operate. The present invention has advantages over previous clamping devices of being relatively simple to construct and easy and fast to assemble and disassemble, and allows rapid accurate use.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
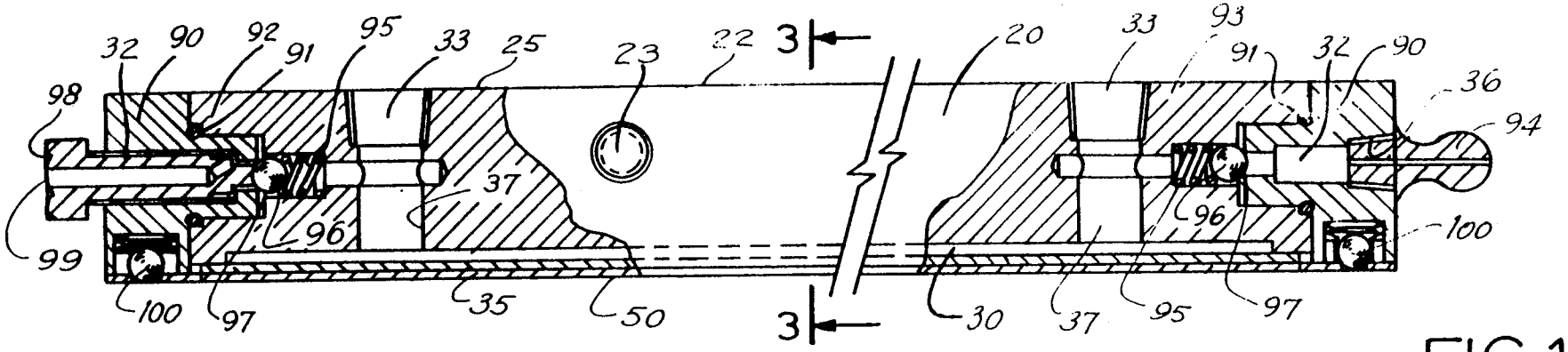
FIG. 1 is bottom plan view of the preferred embodiment of the invention broken away to show interior structures.
Figure 3:
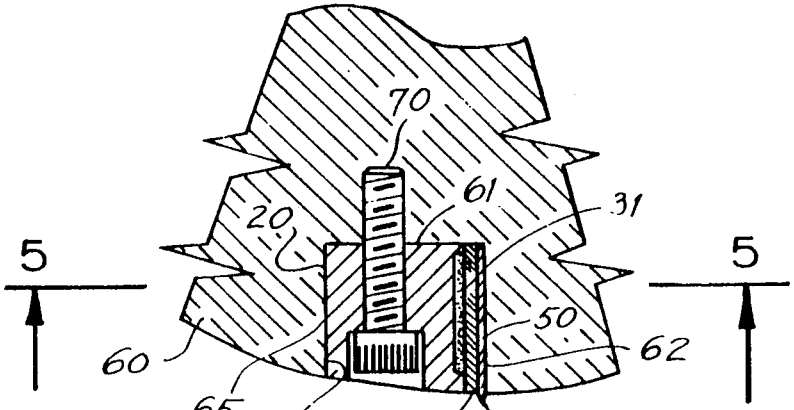
FIG. 3 is a cross sectional view on line 3—3 of FIG. 1 showing the preferred embodiment of the invention and a knife inserted in a machine roll.
Figure 10:
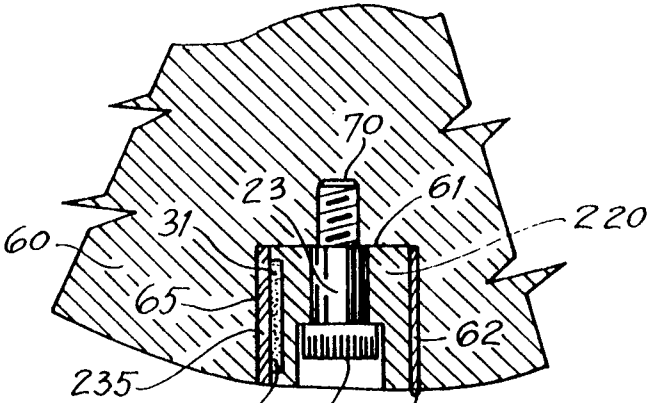
FIG. 10 is a cross sectional view on line 10—10 of FIG. 8 showing the modified embodiment of the invention and a knife inserted in a machine roll.

FIG. 1 shows the clamp bar 20 of the present invention, having a clamping side 35, a non-clamping side 25 and an integral internal cavity 30. Preferably, the clamp bar 20 is made from extruded aluminum or fabricated steel. There are circular bolt holes 23 in middle section 22 for bolts 70 to mount the clamp bar in a machine roll 60 (FIGS. 3 and 10). The internal cavity 30 is filled with a non-compressible fluid, preferably grease 31 (shown in FIG. 5) by means of opening 32 at an end 93 of the bar 20. When the internal cavity 30 is filled with grease, the grease 31 in the internal cavity 30 exerts pressure on the expandible side 35 of the bar 20, causing the side 35 to move outward.

Preferably, the bar 20 of FIG. 1 is sealed in the following manner. A straight threaded pipe plug 90 with "O"-ring seal 91 is threaded into each end 92 and 93 of the bar. The plug 90 at pressure load end 93 is provided with a passage and a ¼-28 grease fitting 94. The fitting 94 will only be used to receive a grease gun (not shown). Additional machining of end 93 of body 20 forms a bore 95 for a spring loaded check ball 96 to retain the pressure. The seat 97 is formed in plug 90. Pressurizing the end 93 permits grease to flow into the bar, to another ball check 96 at the pressure unloading end 92. The ball check 96 moves in a machined hole 95 in the end 92 of body 20. Seat 97 is provided in end plug 90. To release the pressure, the threaded bolt 98 is turned in, contacting the ball check 96 to open a discharge path 99 through the center of the plug 90 allowing cover or side 35 to relax and release knife 50.

Side plugs 33 complete the sealing of the internal chamber 30 when the bar 20 is pressurized.

Also shown in FIG. 1 is the relative positioning of two spring loaded balls 100 which lightly initially locate the tool 50 to be clamped when installing a new tool.

Figure 2:
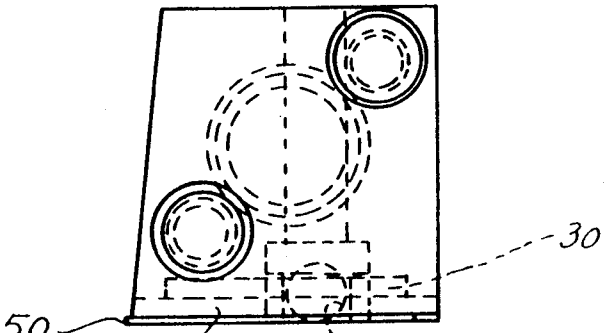
FIG. 2 is a left elevational view of the preferred embodiment of the invention.

FIG. 2 shows a left elevational view of the bar 20 and knife 50. Shadow lines delineate the internal chamber 30.

FIG. 3 is a cross sectional view on line 3—3 of FIG. 1 of the bar as it is used in a machine roll 60 to clamp in place a knife blade 50 to the forward wall 62 of a channel 61 in the machine roll 60. Bolts 70 which extend into the machine roll hold the bar 20 in place in the channel 61. When the bar 20 is inserted in the channel 61 the non-clamping side 25 of the bar lying against the back channel wall 65 and the knife blade 50 is laid flat against the channel forward wall 62, there is a space of about 0.005" between the expandible side 35 and blade 50. When there is no pressure exerted outward by grease in the chamber 30, in the "zero" pressure mode, this gap is sufficient to allow for easy insertion or removal of the blade 50. When the rectangular internal chamber portion 30 is filled with grease 31 in the "high" pressure mode, pressure is exerted on the expandible side 35 causing the clamping side 35 of the bar 20 to move outward like a diaphragm, trapping the knife blade 50 against the channel wall 62. A pressure of up to 10,000 psi may be exerted on the expandable side 35 to allow it to clasp the blade 50 and trap the blade 50 against the channel side 62.

Figure 4:
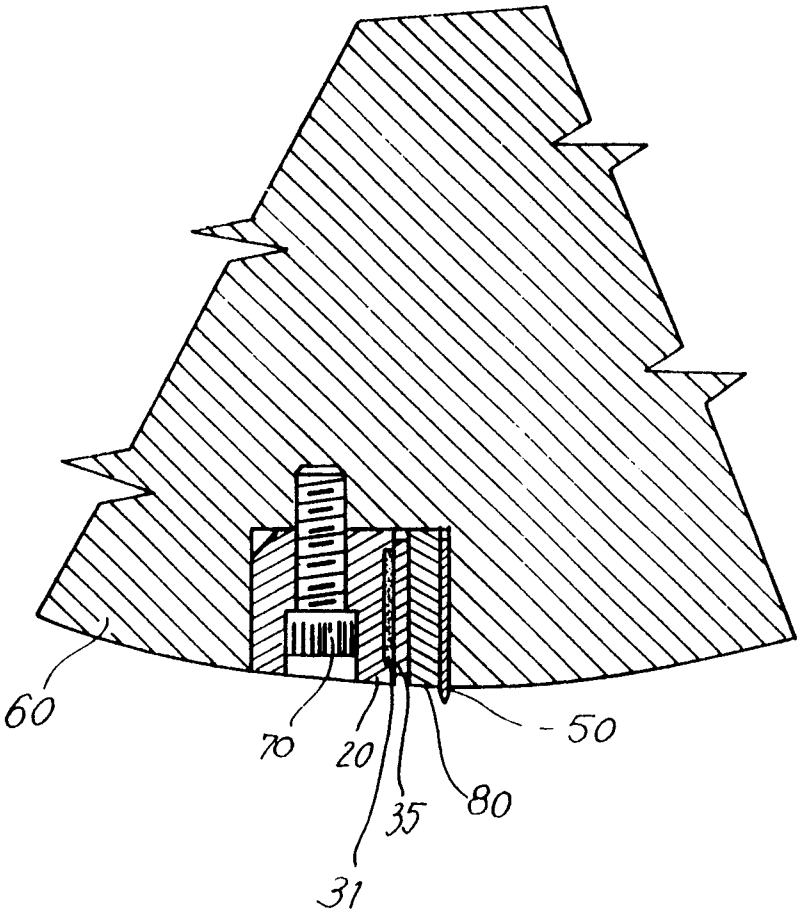
FIG. 4 is a cross sectional view on line 3—3 of FIG. 1 showing the preferred embodiment of the invention, a knife, and a buffer between the clamp bar and knife blade, all inserted in the machine roll.

FIG. 4 shows a modified form of the invention in which a buffer block 80 has been inserted between the bar 20 and the blade 50. When the bar's side wall 35 expands or moves outward under pressure it presses the buffer block 80 against the blade 50 clamping the blade 50 against the channel side wall 62.

Figure 5:
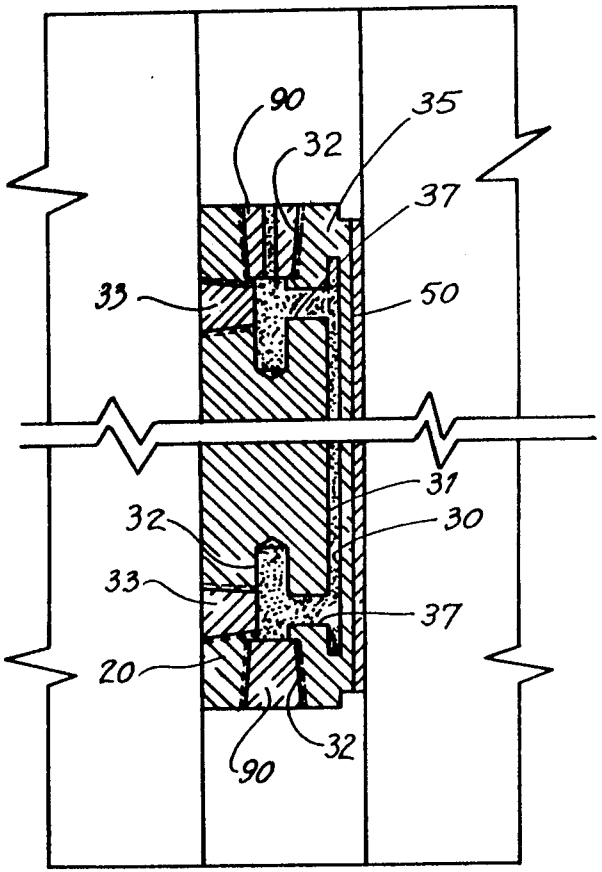
FIG. 5 is a cross sectional view on line 5—5 of FIG. 3 showing the preferred embodiment of the invention and a knife blade inserted in a machine roll.

FIG. 5 shows a cross sectional view on line 5—5 of FIG. 3 of the bar 20 and blade 50 when they are inserted in the channel 61 of the machine roll 60. The cross sectional view allows the shape of the internal cavity with its end bores 32, connecting bores 37, and rectangular chamber 30 to be seen in detail. In this figure, the internal cavity is shown filled with grease 31. The middle section 22 of the bar 20 is omitted from this drawing for convenience. The end plugs 90 are shown without detail.

Figure 6A:
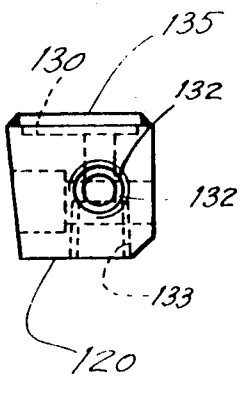
FIG. 6A is a left elevational view of an alternative embodiment to FIG. 6 with shadow lines to show internal structures.
Figure 6:
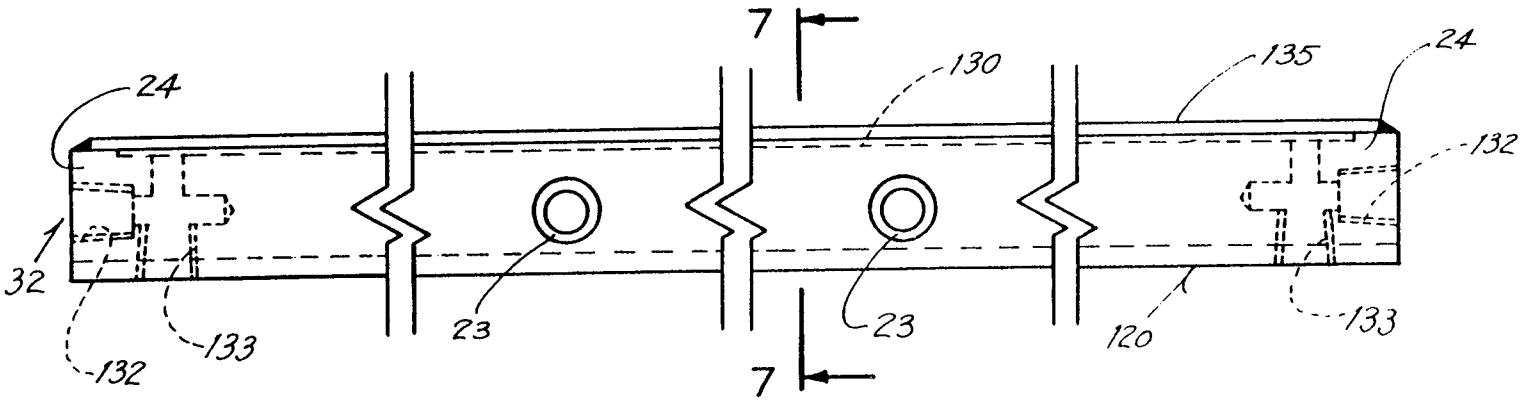
FIG. 6 is a bottom plan view of an alternative embodiment of the invention.

FIGS. 6 and 6A show a modified clamp bar 120 of the present invention. Modified clamp bar 120 has a machined external chamber 130 and end holes 132 and side holes 133. In this embodiment chamber 130 is formed by attaching a metal plate 135, preferably by welding over the rectilinear chamber 130 of the bar 120, and by plugging the end holes 132 and side 133. End holes 132 allow the bar 120 to be filled with grease, and plugged side holes 133 connect the end holes 132 with the rectangular chamber 130. When the internal cavity 130 is filled with grease, the pressure chamber 130 exerts pressure on the metal plate 135, causing the metal plate 135 to move outwardly. The pressure inside the chamber 130 can be released by draining the grease in the chamber by means of openings 132.

Figure 7:
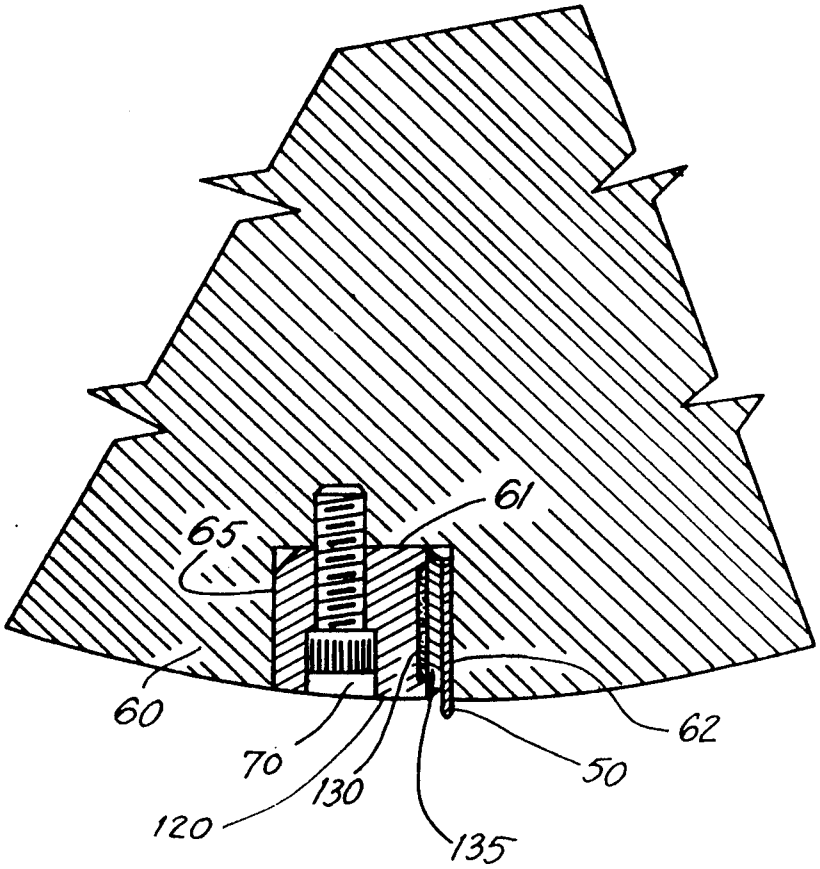
FIG. 7 is a cross sectional view on line 7—7 of FIG. 6 of an alternative embodiment of the invention and a knife inserted in a machine roll.

FIG. 7 is a cross sectional view on line 7—7 of FIG. 6 of the bar as it appears when it is used in machine roll 60 to clamp a knife blade 50 to a wall 62 of a channel 61 in the machine roll 60. Bolts 70 which extend into the machine roll hold the bar 120 in place in channel 61. When the bar 120 is inserted into channel 61 and the knife blade 50 is laid flat against the channel wall 62, there is only a few thousandths of an inch space, preferably a 0.005" space, between the metal plate 135 attached to the bar 120 and the blade 50. When the chamber 130 is filled with grease, pressure is exerted on the metal plate 135 causing the metal plate 135 attached to the bar 120 to expand outwardly like a diaphragm trapping the knife blade 50 against the channel wall 62.

Figure 8:
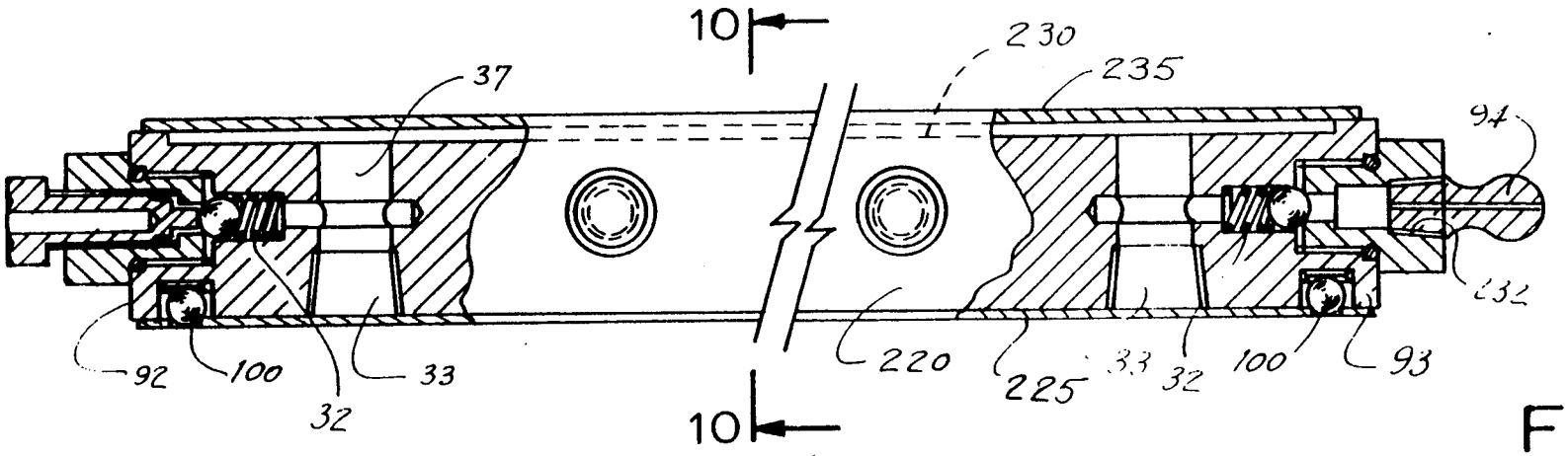
FIG. 8 is a bottom plan view of a modified embodiment of the invention broken away to show internal structures.
Figure 9:
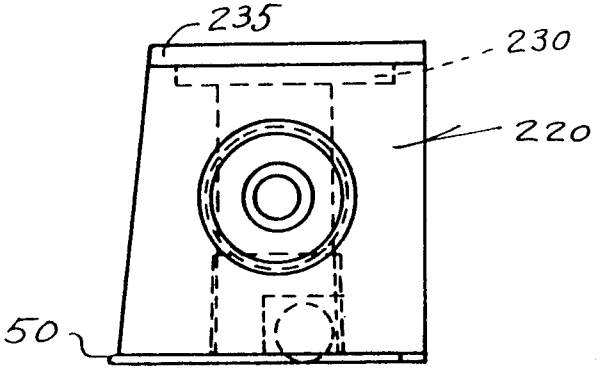
FIG. 9 is a left elevational view of the modified embodiment of FIG. 8.

FIGS. 8, 9 and 10 show a modified reversed clamp bar 220 having a clamping side 235 and a non-clamping side 225 and an internal chamber 230. Preferably, the clamp bar is made from extruded aluminum or fabricated steel. When the internal chamber 230 is filled with grease, the grease in the internal chamber 230 exerts pressure on the movable side 235 of the bar 220, causing the side 235 to expand outward, clamping knife 50. The remaining features are identical to those of the embodiment shown in FIG. 1.

As shown in FIG. 10, when the clamp bar 220 is in use in a machine roll channel 61, when the pressure chamber 230 fills up under pressure with grease 31, pressure is exerted on the expandible side 235, causing it to move against the back side 65 of the channel 61, thereby clamping the blade 50 in place.

Figure 11:
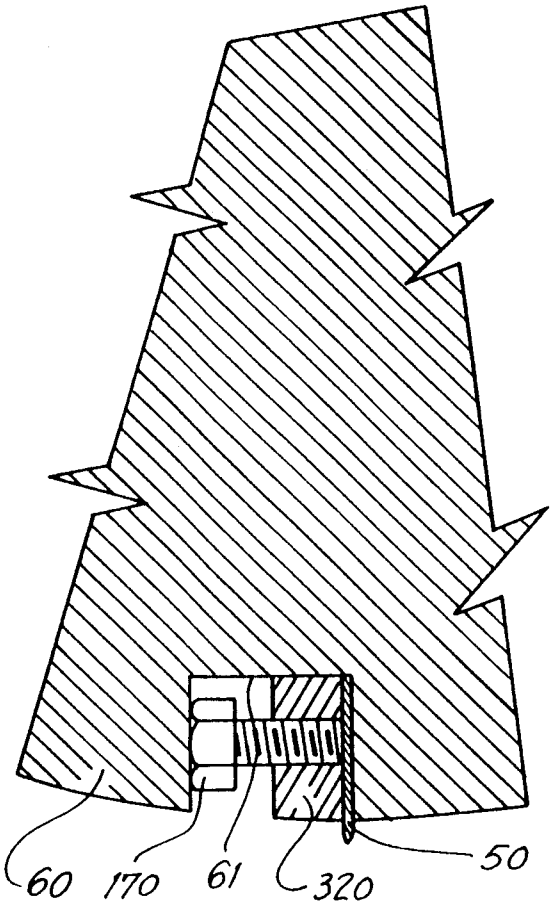
FIG. 11 PRIOR ART
FIG. 11 is a view of conventional prior art clamping means inserted in a machine roll.

FIG. 11 shows a prior art blade clamp 50 clamped in a channel 61 in a machine roll 60 using multiple bolts 170 (one shown) which extend into block 320. The bolts 170 when backed against channel 61 exert pressure on the block 320 to clamp the blade 50.

The operation of the device to clamp a tool is described at the end of the summary of the invention.

The above described embodiments of this invention are merely descriptive of its principles and are not to be limiting. The scope of this invention instead shall be determined from the scope of the following claims, including their equivalents.

What is claimed is:

1. A system for mounting an elongated tool into a channel formed in a roll, the channel being defined by first and second spaced side walls and a bottom wall, the tool being positioned against one of the side walls of the channel, comprising:

a bar member receivable within the channel and including a first wall located closely adjacent one of the channel side walls and a second wall located closely adjacent the tool, the bar member including an internal cavity defined at least in part by one of the bar member first and second walls which comprises a deflectable wall lying in a plane substantially parallel to the channel side wall against which the tool is positioned; and an arrangement for introducing a quantity of substantially non-compressible fluid under pressure into the bar member internal cavity and for maintaining the fluid under pressure within the cavity;

wherein the deflectable wall is provided with a thickness allowing it to deflect laterally outwardly toward one of the channel side walls when fluid under pressure is introduced into the bar member internal cavity, thereby providing lateral expansion of the bar member within the channel and sandwiching the tool between the bar member second wall and channel side wall against which the tool is positioned.

2. The system of claim 1, wherein the deflectable wall is located closely adjacent the tool.

3. The system of claim 1, wherein the deflectable wall is located closely adjacent one of the channel side walls.

4. The system of claim 1, wherein the deflectable wall is integrally formed with the bar member.

5. The system of claim 1, wherein the bar member internal cavity comprises a recess formed in the bar member, and wherein the deflectable wall comprises a plate member overlying the recess and secured to the bar member adjacent the recess.

6. The system of claim 5, wherein the plate member is welded to the bar member over the recess.

7. The system of claim 1, wherein the arrangement for introducing and maintaining fluid under pressure within the cavity includes a check valve.

8. The system of claim 1, further comprising a buffer member placed within the channel and located between the tool and the second wall of the bar member.

9. The system of claim 1, further comprising a spring loaded retainer arrangement provided on the bar member second wall for engaging the tool and retaining the tool in position within the channel during introduction of pressurized fluid into the bar member internal cavity.

* * * * *